US012090380B2

(12) United States Patent
Zou et al.

(10) Patent No.: US 12,090,380 B2
(45) Date of Patent: Sep. 17, 2024

(54) COMBAT TRAINING EQUIPMENT

(71) Applicant: Beijing Quanshineng Sports Technology Co., Ltd., Beijing (CN)

(72) Inventors: Jiarui Zou, Beijing (CN); Guojun Zou, Beijing (CN)

(73) Assignee: Beijing Quanshineng Sports Technology Co., Ltd., Beijing (CN)

( * ) Notice: Subject to any disclaimer, the term of this patent is extended or adjusted under 35 U.S.C. 154(b) by 202 days.

(21) Appl. No.: 17/847,397

(22) Filed: Jun. 23, 2022

(65) Prior Publication Data

US 2023/0233919 A1 Jul. 27, 2023

(30) Foreign Application Priority Data

Jan. 26, 2022 (CN) ..... 202210094210.6

(51) Int. Cl.
*A63B 69/22* (2006.01)
*A63B 69/32* (2006.01)
*A63B 71/06* (2006.01)

(52) U.S. Cl.
CPC ..... *A63B 69/22* (2022.08); *A63B 69/32* (2013.01); *A63B 71/0622* (2013.01); *A63B 2071/0625* (2013.01); *A63B 2225/74* (2020.08); *A63B 2244/10* (2013.01)

(58) Field of Classification Search
CPC . A63B 24/0075; A63B 69/24; A63B 24/0021; A63B 24/0062; A63B 69/244; A63B 71/0622; A63B 2244/10; A63B 2024/0025; A63B 2225/093; A63B 2214/00; A63B 2024/0009; A63B 2220/56; A63B 2071/0647; A63B 2220/05; A63B 2220/10; A63B 2220/836; A63B 69/22; A63B 69/32; A63B 2071/0625; A63B 2225/74; A63B 2220/833; A63B 69/0053;
(Continued)

(56) References Cited

U.S. PATENT DOCUMENTS 1,813,006 A * 7/1931 White ..... A61H 1/0266 601/31
7,244,219 B1 * 7/2007 Preciado ..... A63B 69/224 482/90
11,311,787 B2 * 4/2022 Kawar ..... A63B 24/0075
(Continued)

*Primary Examiner* — Loan B Jimenez
*Assistant Examiner* — Andrew M Kobylarz
(74) *Attorney, Agent, or Firm* — Birchwood IP

(57) ABSTRACT

A combat training equipment relates to the technical field of combat training equipment. The existing combat training equipment is not equipped with active attack function, which is not conducive to the trainers to improve their combat level; the new combat training equipment drives the motor to cooperate with the angle box, angle motor, oscillating piece and hanging ball, so as to oscillate at a certain angle. Driven by the angle motor, the oscillating piece can simulate a human arm attacking in the upper, middle, and lower positions. With the help of hanging ball, the trainers can carry out body movement training to improve the reaction capability. The striking mechanism, lamps and speakers on the striking post enable trainers to evade attacks with good coordination. After the trainers make an effective attack, the speakers and lights will give positive feedback respectively, so that the trainers can gradually improve their own strength.

6 Claims, 5 Drawing Sheets

(58) Field of Classification Search
CPC ..... A63B 2220/53; A63B 2220/801; A63B 2225/50; A63B 69/34
See application file for complete search history.

(56) References Cited

U.S. PATENT DOCUMENTS

| | | | | |
|---|---|---|---|---|
| 2010/0130329 | A1* | 5/2010 | Sullivan | A63B 69/22 482/4 |
| 2022/0016509 | A1* | 1/2022 | Fazio | A63B 69/22 |
| 2022/0161116 | A1* | 5/2022 | Curry | A63B 69/22 |

* cited by examiner

COMBAT TRAINING EQUIPMENT

CROSS-REFERENCE TO RELATED APPLICATIONS

This is a U.S. patent application which claims the priority and benefit of Chinese Patent Application Number 202210094210.6, filed on Jan. 26, 2022, the disclosure of which is incorporated herein by reference in its entirety.

TECHNICAL FIELD

The present invention is related to the technical field of training equipment. More specifically, the present invention is directed to a type of combat training equipment.

BACKGROUND

Combat (kickboxing), also known as standing grapple in which the one is not allowed to hit the other who falls to the ground. In addition to not allowing the application of techniques such as articular reversing and elbowing, wrestling is also prohibited to a certain extent in this sport. Combat is also known as free combat and western full-contact free karate.

Free combat does not stick to any fixed moves, but encourages the players to adopt techniques at their own wills while paying attention to the progress in actual combat. With such free fighting style, the players can flexibly adopt various three-dimensional techniques such as boxing, kicking, elbowing, kneeing, and wrestling, and give full play to their capabilities, and finally achieve the goal of knocking down or defeating their opponents. "By learning the basic principles, I can come up with a unique technique perfectly fits me." This is the best phrase to illustrate the concept of free combat.

With the guidance of such philosophy, a perfect theoretical, technical, and tactical system and competition rules have established in the field of free combat after decades of practice and complementing each other, implying that techniques such as boxing and kicking are allowed in "free combat".

With the promotion of the national fitness campaign, the public has paid more and more attention to physical exercise. Combat training is a sport effective in exercising the whole body by allowing the trainers to stay focused while improving the flexibility and coordination of various parts of the body and cardiorespiratory endurance. Under the social context with great competitive pressure nowadays, combat training is one of the best ways for the trainers to cope with stress and keep challenging themselves. By participating in free combat, people are allowed to keep clear-headed, quick-witted with better adaptability. Apart from that, free combat plays an essential role in reducing weight and improving general fitness.

Free combat, also known as international free combat, does not stand on any fixed moves, and yet, encourages the players to be free in adopting skills while paying attention to the progress in actual combat. With such free fighting style, the players can flexibly adopt various three-dimensional techniques such as boxing, kicking, elbowing, kneeing, and wrestling, and give full play to their capabilities, and finally achieve the goal of knocking down or defeating their opponents. In order to achieve better effects, athletes usually utilize special combat training equipment.

The existing hanging and vertical combat training equipment usually requires trainers to conduct training by themselves and cannot be applied for footwork practice. In addition, the existing combat training equipment is not equipped with active attack function, which is not conducive for the trainers to improve their combat level. Therefore, this design is intended to put forward a combat training equipment which can help the trainers to carry out various training pattern with active attack.

SUMMARY

In view of the shortcomings of prior arts, this invention is directed to a type of combat training equipment which comprises a striking post and a chassis. The chassis is installed on the top of the hitting column, and the chassis is equipped with a control circuit that is equipped with a microprocessor. The features of the training equipment are as follows: the hitting column is equipped with a hitting mechanism, and is connected to the chassis via a connecting component, and the chassis is equipped with a driving motor. The connecting component is an arc piece, which reserves sufficient space for the movement of the oscillating piece. The central part of the hitting column is rotationally connected with a driven rod, and a driving rod is arranged next to the driven rod. The chassis and the hitting column are rotationally connected through the driving rod. The driven rod is equipped with a driven gear, and the driving rod is equipped with a driving gear. The driving gear and the driven gear are meshed with each other. The driving rod is driven by the driving motor, and either end of the driven gear is connected to the angle box through the piece No. 1. The angle box is slidably connected with the chassis and the hitting column. The angle box is equipped with a carbon brush, and the top surface of the hitting column is attached with a sliding contact wire that is slidably connected with the carbon brush. The sliding contact wire and carbon brush can always supply power to the moving angle motor. The angle box is equipped with a dual-shaft angle motor. The driving shaft of the angle motor is equipped with a U-shaped piece whose outer end is connected with the oscillating piece, and the angle box is equipped with a chute for the movement of the oscillating piece. The dual-shaft angle motor can avoid unstable connection occurring when only one shaft is connected with U-shaped parts. The movable end of the oscillating piece is equipped with an up-down connected hole, which is rotationally connected with a winding rod. The winding rod protrudes from the oscillating piece whose end is attached with a square chute. The end of the winding rod is hinged with a clamping rod that is matched with the square chute. The winding rod is wound with a rope, and one end of the rope is hung with a hanging ball; the left and right end surfaces of the connecting component are equipped with holes numbered as 1 and 2 separately. These two holes are arranged up and down without connection. The No. 1 and No. 2 holes are slidably connected with a guiding rod. One end of the guiding rod is connected with the outer wall of the angle box, and the other is pressed with a spring. The microprocessor is electrically connected with the driving motor, the angle motor, the carbon brush and the sliding contact wire.

As an optimal technical scheme of the invention, the length of the guiding rod is greater than half of the length of the connecting component.

As an optimal technical scheme of the invention, a loudspeaker is attached on the top surface of the chassis, and is electrically connected with the microprocessor. After the trainers complete effective hitting, the loudspeaker will play cheering sounds to encourage the trainers to continue training.

As an optimal technical scheme of the invention, the bottom surface of the hitting column is equipped with a spiral groove, and a hemispherical counter weight is arranged beside the hitting column. The top surface of the counter weight is attached with a threaded stub that is matched with the spiral groove. When the trainers have almost completed the fundamental training, the counterweight can be installed to make the whole equipment into a tumbler state that provides more attack patterns, so that the trainers can obtain better training effect while increasing the training difficulty.

As an optimal technical scheme of the invention, the hanging ball is made of soft material.

As an optimal technical scheme of the invention, the hitting column is equipped with an inner column that is equipped with a keel. The outer wall of the hitting column is equipped with a groove, which is symmetrically arranged on the left and right with multiple sets. The groove is equipped with the hitting mechanism, which includes a connecting rod, an air bag, a hitting position, an ejector block, a slider, a sliding piece, a reset spring, a gravity sensor, and a contact spring. The outer wall of the inner column is equipped with a chute No. 2 corresponding to the groove position. The groove No. 2 is slidably connected with the slider, and is internally equipped with the air bag. The slider is externally equipped with the ejector block. A deep hole is arranged next to the groove No. 2, and is slidably connected with the connecting rod. The connecting rod is internally equipped with the contact spring. The inner bottom surface of the deep hole is equipped with the gravity sensor. The inner wall of the deep hole is equipped with an elongated groove. The outer wall of the connecting rod is equipped with a reset block that is slidably connected with the inner of the elongated groove, and the reset spring is press-fitted between the reset block and the elongated groove. After hitting, the return spring and the return block will work together to restore the equipment and prepare it for the next round of hitting training. The groove is equipped with the hitting position made of rubber. The microprocessor is electrically connected with the gravity sensor.

As an optimal technical scheme of the invention, the outer surface of the ejector block is equipped with an inner concave arc surface.

As an optimal technical scheme of the invention, the hitting column is equipped with multiple sets of grooves that are equipped with lamps, and the lamps are electrically connected with the microprocessor. Under the control of the microprocessor, the lamp will display different colors according to the different hitting strength applied by the trainers to encourage the them to improve further.

The benefits of the invention: when the driving motor works together with the angle box, angle motor, and hanging ball, the invention can oscillate at a certain angle. Driven by the angle motor, the oscillating piece can simulate a human arm attacking in the upper, middle, and lower positions. At the same time, with the help of the hanging ball, the trainers can carry out body movement training to improve their reaction capability. The striking mechanism, lamps and speakers on the striking post enable trainers to evade attacks with good coordination. After the trainers make an effective attack, the speakers and lights will give positive feedback in turn to improve the training enthusiasm of the trainers, so that the trainers can gradually improve their own strength.

Further, after the counter weight is installed, the coordination between the counterweight and the hitting column makes the whole equipment operate like a tumbler. A force can be applied to the equipment to activate the oscillating mode and cooperate with various components to increase the difficulty of training and improve the training effect.

BRIEF DESCRIPTION OF DRAWINGS

In order to explain the embodiments of the invention or the existing technical scheme, the following will briefly introduce the drawings provided for the descriptions of embodiments or existing technical scheme. All elements or parts in the figures are not necessarily drawn to the actual scale.

Figure 1:
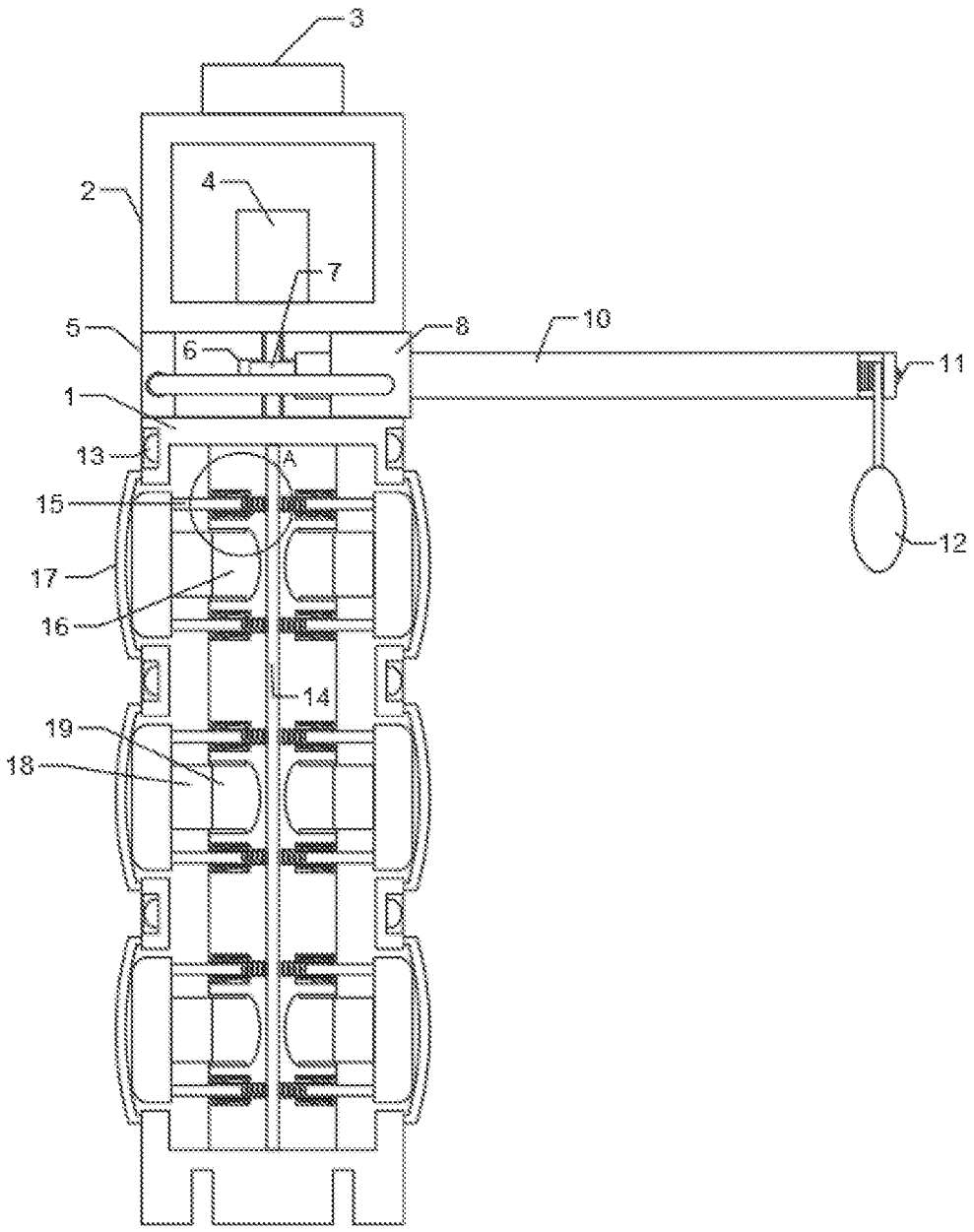
FIG. 1 shows the structural diagram of the invention.

In the drawings: 1. Hitting column; 2. Chassis; 3. Loudspeaker; 4. Drive motor; 5. Connecting component; 6. Driving gear; 7. Driven gear; 8. Angle box; 9. Angle motor; 10. Oscillating piece; 11. Winding rod; 12. Hanging ball; 13. Lamp; 14. Keel; 15. Connecting rod; 16. Air bag; 17. Hitting position; 18. Ejector block; 19. Slider; 20. Sliding piece; 21. Reset spring; 22. Gravity sensor; 23. Contact spring; 24. Guiding rod.

DETAILED DESCRIPTION

The technical scheme of the invention will be clearly and completely described below in combination with the accompanying drawings. In the description of the invention, it should be noted that the orientation or position relationship indicated by the terms "center", "upper", "lower", "left", "right", "vertical", "horizontal", "inner" and "outer" is based on the orientation or position relationship shown in the attached drawings, only for the convenience of describing the invention and simplifying the description, rather than indicating or implying that the equipment or element must have a specific orientation or it should be constructed and operated in a specific orientation, and therefore, they should not be interpreted as a limitation of the invention. In addition, the terms "first", "second" and "third" are employed only for descriptive purposes and should be interpreted as the indication or implication of the relative importance.

It should be noted that in the description of the invention, unless otherwise expressly specified and defined, the terms "install", "connect" and "link" should be interpreted in a broad sense, for example, it can be fixed, detachable or integrated; it can be mechanical or electrical; it can be direct or indirect with a medium, and it can be applied to two different components. For those skilled in the field, the specific meanings of the above terms in the invention can be interpreted under specific circumstances.

Embodiment 1

Figure 2:
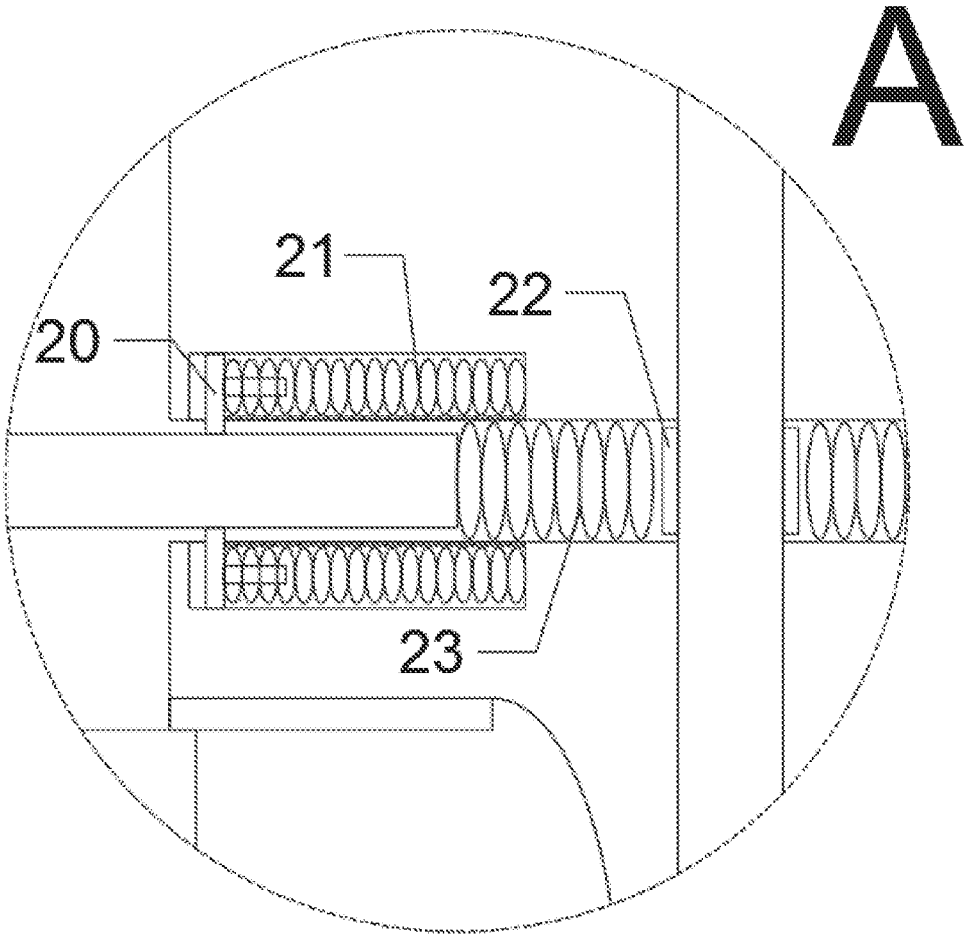
FIG. 2 shows an enlarged structural diagram of part A of the invention.
Figure 3:
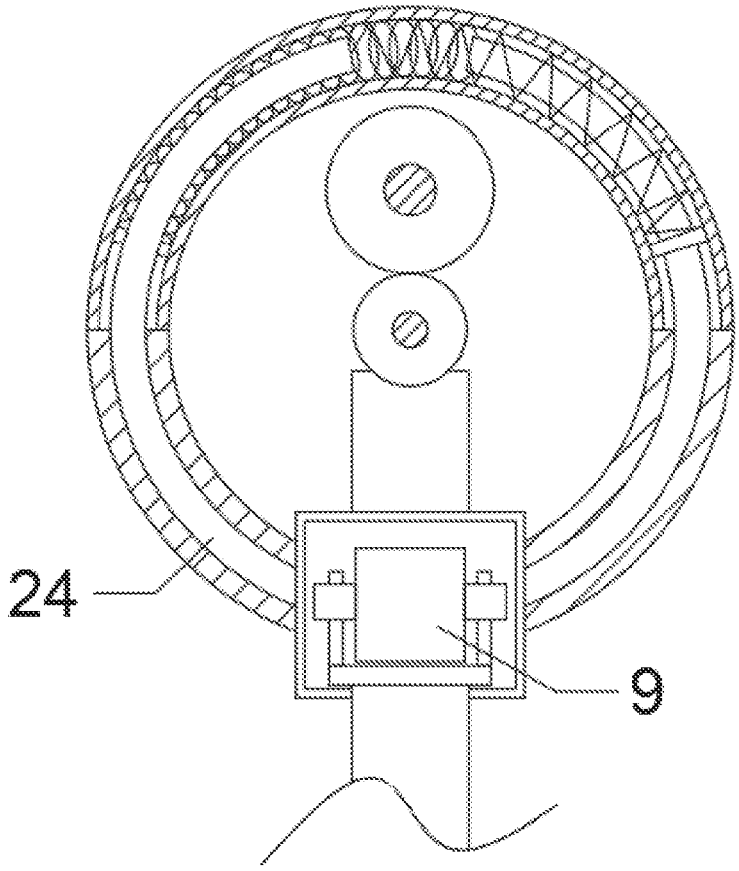
FIG. 3 shows the structural diagram of the connecting component of the invention.
Figure 4:
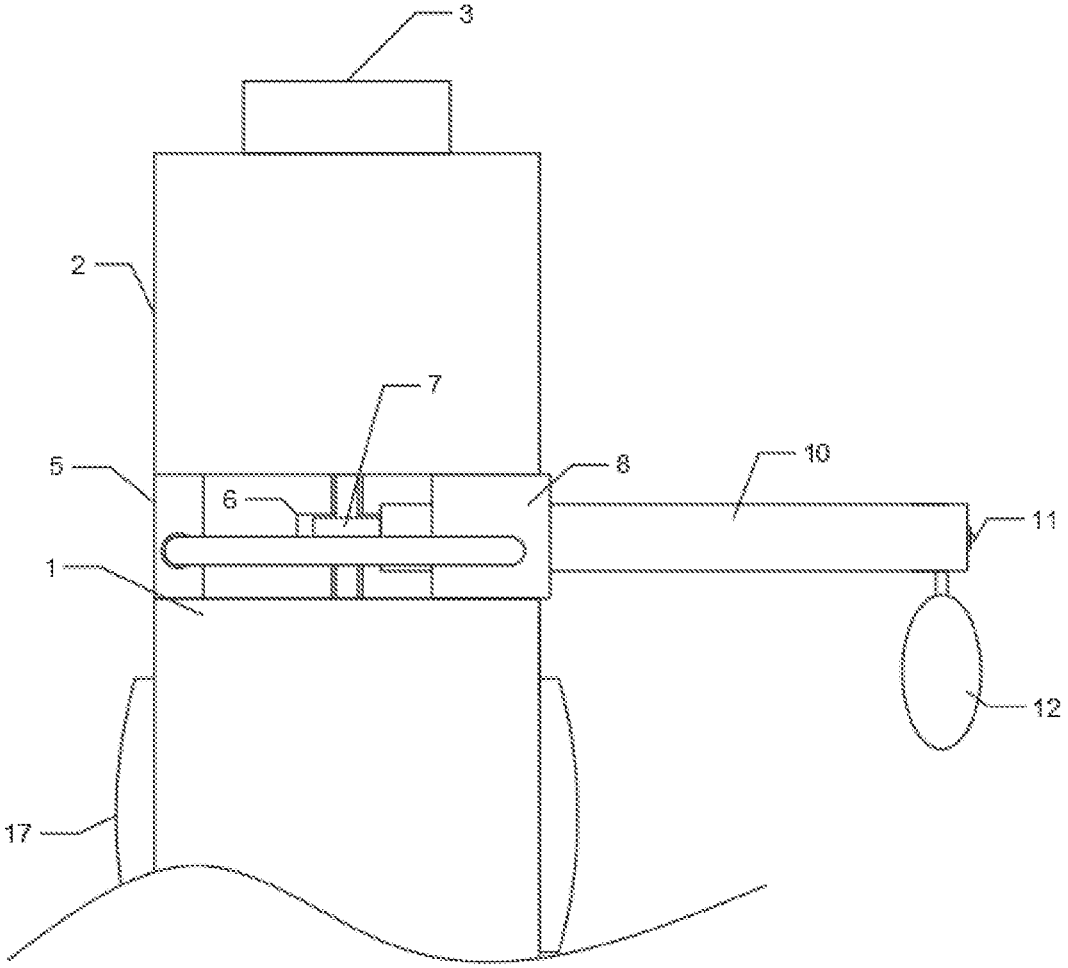
FIG. 4 shows the first structural diagram of the invention.
Figure 5:
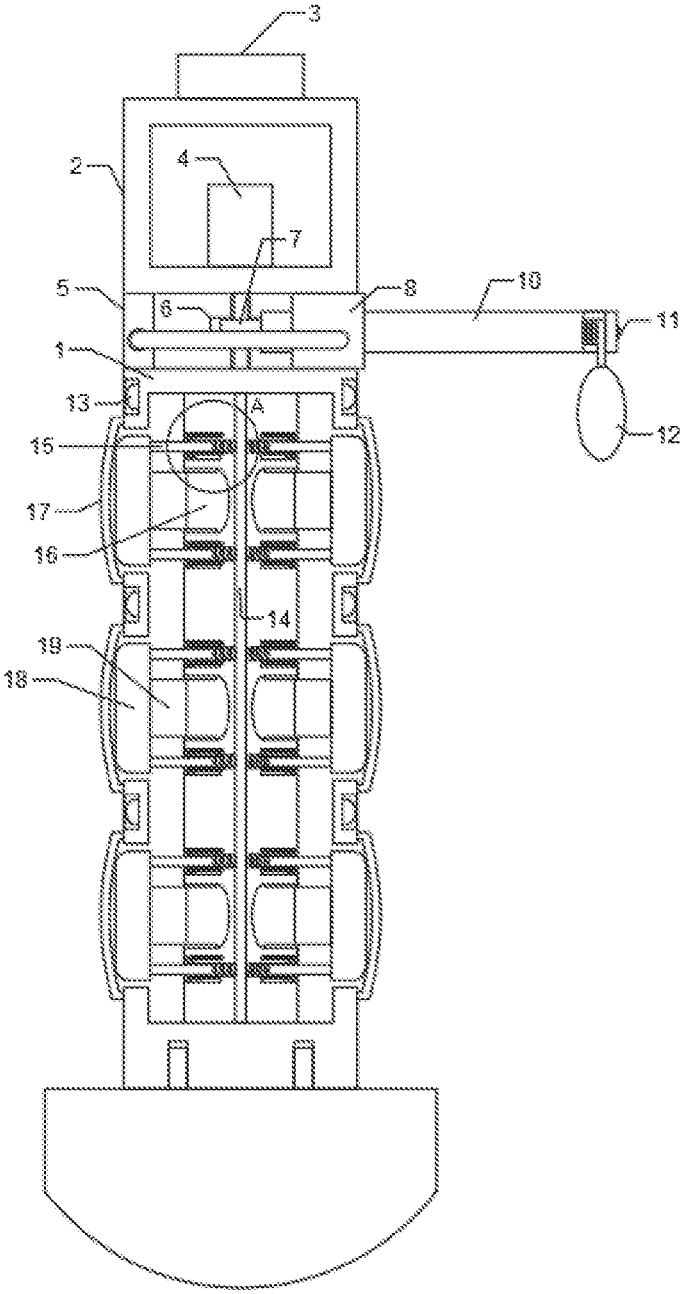
FIG. 5 shows the second structural diagram of the invention.

As shown in FIGS. 1 to 5, this invention is directed to a type of combat training equipment comprising a hitting column 1 and a chassis 2. The chassis 2 is installed on the top of the hitting column 1, and the chassis 2 is equipped with a control circuit that is equipped with a microprocessor. The features of the training equipment are as follows: the hitting column 1 is equipped with a hitting mechanism, and is connected to the chassis 2 via a connecting component 5 and the chassis 2 is equipped with a driving motor 4. The connecting component 5 is an arc piece. The central part of the hitting column 1 is rotationally connected with a driven rod, and a driving rod is arranged next to the driven rod. The chassis 2 and the hitting column 1 are rotationally connected through the driving rod. The driven rod is equipped with a driven gear 7, and the driving rod is equipped with a driving gear 6. The driving gear 6 and the driven gear 7 are meshed with each other, the driving rod is driven by the driving motor 4, and one end of the driven gear 7 is connected to the angle box 8 through the piece No. 1. The angle box 8 is slidably connected with the chassis 2 and the hitting column 1. The angle box 8 is equipped with a carbon brush, and the top surface of the hitting column 1 is attached with a sliding contact wire that is slidably connected with the carbon brush. The carbon brush in coordination with the sliding contact wire can supply power to the moving angle motor and avoid power failure. The angle box 8 is equipped with a dual-shaft angle motor 9. The driving shaft of the angle motor 9 is equipped with a U-shaped piece whose outer end is connected with the oscillating piece 10, and the angle box 8 is equipped with a chute for the movement of the oscillating piece 10. The movable end of the oscillating piece 10 is equipped with an up-down connected hole, which is rotationally connected with a winding rod 11. The winding rod 11 protrudes from the oscillating piece 10 whose end is attached with a square chute. The end of the winding rod 11 is hinged with a clamping rod that is matched with the square chute. The winding rod 11 is wound with a rope, and one end of the rope is hung with a hanging ball 12; by cooperating with the winding rod, the rope can be contracted or extended according to the needs of the trainers, thus further increasing the training difficulty; the left and right end surfaces of the connecting component 5 are equipped with holes numbered as 1 and 2 separately. These two holes are arranged up and down without connection. The No. 1 and No. 2 holes are slidably connected with a guiding rod 24. One end of the guiding rod 24 is connected with the outer wall of the angle box 8, and the other is press-fitted with a spring; the microprocessor is electrically connected with the driving motor 4, the angle motor 9, the carbon brush and the sliding contact wire.

As an optimal technical scheme of the invention, the length of the guiding rod 24 is greater than half of the length of the connecting component 5, so as to prevent the guide rod at one end from detaching from the connecting component and getting off track when the angle box rotates at a certain angle.

As an optimal technical scheme of the invention, a loudspeaker 3 is attached on the top surface of the chassis 2, and is electrically connected with the microprocessor. After the trainers complete effective hitting, the loudspeaker will play cheering sounds to encourage the trainers to continue training.

As an optimal technical scheme of the invention, the bottom surface of the hitting column 1 is equipped with a spiral groove, and a hemispherical counter weight is arranged beside the hitting column 2. The top surface of the counter weight is attached with a threaded stub that is matched with the spiral groove. The counterweight can be installed to increase the training difficulty accordingly.

As an optimal technical scheme of the invention, the hanging ball 12 is made of soft material.

As an optimal technical scheme of the invention, the hitting column 1 is equipped with an inner column that is equipped with a keel 14. The outer wall of the hitting column 1 is equipped with a groove, which is symmetrically arranged on the left and right with multiple sets. The groove is equipped with the hitting mechanism, which includes a connecting rod 15, an air bag 16, a hitting position 17, an ejector block 18, a slider 19, a sliding piece 20, a reset spring 21, a gravity sensor 22 and a contact spring 23. The outer wall of the inner column is equipped with a groove No. 2 corresponding to the groove position. The groove No. 2 is slidably connected with the slider 19, and is internally equipped with the air bag 16. The slider 19 is externally equipped with the ejector block 18. A deep hole is arranged next to the groove No. 2, and is slidably connected with the connecting rod 15. The connecting rod 15 is internally equipped with the contact spring 23. The inner bottom surface of the deep hole is equipped with the gravity sensor 22. The inner wall of the deep hole is equipped with an elongated groove. The outer wall of the connecting rod 15 is equipped with a reset block that is slidably connected with the inner of the elongated groove, and the reset spring 21 is press-fitted between the reset block and the elongated groove, and the groove is equipped with the hitting position 17 made of rubber. The microprocessor is electrically connected with the gravity sensor 22. When hitting the internal gravity sensor, the loudspeaker can play different sounds according to the strength exerted by the trainers, so as to encourage them to continue training.

As an optimal technical scheme of the invention, the outer surface of the ejector block 18 is devised with an inner concave arc surface.

As an optimal technical scheme of the invention, the hitting column 1 is equipped with multiple sets of grooves that are equipped with the lamp 13, and the lamp 13 are electrically connected with the microprocessor. Under the control of the microprocessor, the lamp will display different colors according to the different hitting strength applied by the trainers.

The operating principle of the invention: after the training equipment is placed at the training site, the driving motor 4 is controlled by a microprocessor in the circuit. The driving motor 4 drives the driving gear 6 and the driven gear 7 to rotate with the driving rod, and then drives the angle box 8 to oscillate back and forth between the top surface of the hitting column 1 and the chassis 2. With the coordination between the No. 1 and No. 2 holes on guiding rod 24 and the connecting component 5, the spring can simulate the inertia borne by the arms when waving. Subsequently, the sliding contact wire and the carbon brush supply power to the angle motor 9 in the angle box 8 in a cooperative manner, so that the oscillating piece 10 driven by the angle motor 9 can oscillate in upper, middle and lower positions inside the chute, so as to simulate the arms initiating attacks. The winding rod 11 and the hanging ball 12 on the oscillating piece 10 can carry out weapon simulation in a cooperative way, which increases the difficulty of training, and in turn improve the training effect; the trainer can conduct attack training together with the oscillating piece 10. When hitting the hitting position 17 on the hitting column 1, the ejector block 18 under the hitting position 17 applies a force to the slider 19, and then compresses the air bag 16 in the groove No. 2. The connecting rod 15 compresses the contact spring 23 synchronously, so that the contact spring 23 can compress the gravity sensor 22 in the deep hole. The lamp 13 and the loudspeaker 3 can display corresponding colors and sounds according to the force exerted by the trainers to encourage them to continue training. Then, the reset spring 21 and the reset block in the elongated groove will extend the connecting rod 15 outward in a cooperative manner and flatten the air bag 16. When the slider 19 slides outward, the ejector block 18 pushes the hitting position up again. Subsequently, after the counter weight is installed on the bottom surface of the hitting column 1, the trainers are allowed to carried out irregular simulation training.

The microprocessor involved in the invention is adopted with STM32 chip to start and stop motor, sensor, loudspeaker, and lamp. For the pins and connection mode of STM32, those skilled in the field can obtain technical enlightenment by referring to teaching materials or technical manuals published by manufacturers. The circuit connection involved in the invention is frequently adopted by those skilled in the field, and is considered as common general knowledge that can be interpreted through a limited number of tests.

Components not described in detail herein are prior arts.

Despite the detailed description of the embodiments of the invention above, the invention is not limited to the embodiments set out herein. Within the scope of knowledge possessed by technicians in the field, various changes can be made without departing from the purpose of the invention, and the modification or deformation without creative labor is still within the protection scope of the present invention.

What is claimed is:

1. A combat training equipment comprising: a hitting column and a chassis, the chassis is installed on a top of the hitting column, wherein the hitting column is equipped with a hitting mechanism, and is connected to the chassis via a connecting component, and the chassis is equipped with a driving motor a driving gear and a driven gear are meshed with each other, and one end of the driven gear is connected to an angle box, the angle box is slidably connected with the chassis and the hitting column, the angle box is equipped with a dual-shaft angle motor, a driving shaft of the angle motor is equipped with a U-shaped piece whose outer end is connected with an oscillating piece, a winding rod protrudes from the oscillating piece, the winding rod is wound with a rope, and one end of the rope is hung with a hanging ball, one end of a guiding rod is connected with an outer wall of the angle box, wherein the hitting mechanism comprises a connecting rod, an air bag, a hitting position, an ejector block, a slider, a sliding piece, a reset spring, a gravity sensor, and a contact spring.

2. The combat training equipment of claim 1, wherein a length of the guiding rod is greater than half the length of the connecting component.

3. The combat training equipment of claim 1, wherein a loudspeaker is attached on a top surface of the chassis.

4. The combat training equipment of claim 1, wherein the hanging ball is made of soft material.

5. The combat training equipment of claim 1, wherein the hitting column is equipped with an inner column that is equipped with a keel, the slider is externally equipped with the ejector block, the connecting rod is internally equipped with the contact spring, an outer wall of the connecting rod is equipped with a reset block that is slidably connected with an inner of the elongated groove, and the reset spring is press-fitted between the reset block and the elongated groove.

6. The combat training equipment of claim 5, wherein an outer surface of the top block is devised with an inner concave arc surface.

* * * * *